US010988293B2

(12) United States Patent
Wegner et al.

(10) Patent No.: US 10,988,293 B2
(45) Date of Patent: Apr. 27, 2021

(54) FLEXIBLE TUBULAR PACKAGE FOR EDIBLE PRODUCT

(75) Inventors: Kenneth E. Wegner, Elmhurst, IL (US); Anthony Simon Richards, Oak Park, IL (US); Andrew J. Rush, Woodridge, IL (US)

(73) Assignee: THE JEL SERT COMPANY, West Chicago, IL (US)

( * ) Notice: Subject to any disclaimer, the term of this patent is extended or adjusted under 35 U.S.C. 154(b) by 2124 days.

(21) Appl. No.: 13/065,227

(22) Filed: Mar. 17, 2011

(65) Prior Publication Data

US 2012/0237643 A1 Sep. 20, 2012

(51) Int. Cl.

| | |
|---|---|
| ***B65D 81/32*** | (2006.01) |
| ***B65B 51/10*** | (2006.01) |
| ***B65B 43/08*** | (2006.01) |
| ***B65B 3/02*** | (2006.01) |
| ***B65D 75/42*** | (2006.01) |
| ***B65B 25/00*** | (2006.01) |
| ***B65B 9/02*** | (2006.01) |
| *B65D 85/72* | (2006.01) |

(52) U.S. Cl.

CPC ..... *B65D 75/42* (2013.01); *B65B 9/023* (2013.01); *B65B 25/005* (2013.01); *B65B 25/007* (2013.01); *B65D 81/3261* (2013.01); *B65D 85/72* (2013.01)

(58) Field of Classification Search

CPC ... B29C 65/18; B29C 66/83413; B65D 75/42; B65D 81/3261; B65D 85/72; B65D 81/32; B65D 35/10; B65D 35/22; B65B 9/02; B65B 9/026; B65B 51/303; B65B 51/30; B65B 51/26; B65B 65/08; B65B 9/023; B65B 25/007; B65B 25/005

USPC ..... 53/474, 450, 451, 576, 574, 555, 553, 53/477, 548, 551; 493/243, 251, 186; 156/73.4; 206/219; 83/883, 884, 886, 83/678, 863

See application file for complete search history.

(56) References Cited

U.S. PATENT DOCUMENTS

| | | | | |
|---|---|---|---|---|
| 3,210,908 | A * | 10/1965 | Samberg | 53/546 |
| 3,250,384 | A * | 5/1966 | Perino | B32B 27/00 156/259 |
| 3,391,047 | A * | 7/1968 | Kopp | 156/553 |
| 3,401,585 | A * | 9/1968 | Schmermund | 83/341 |

(Continued)

FOREIGN PATENT DOCUMENTS

| | | |
|---|---|---|
| ES | 2 088 745 | 3/1997 |

*Primary Examiner* — Robert F Long
*Assistant Examiner* — Eduardo R Ferrero
(74) *Attorney, Agent, or Firm* — Olson & Cepuritis, Ltd.

(57) ABSTRACT

A squeezable, flexible tubular package for an edible product is compartmented to simultaneously hold a first edible product in one compartment separate from a second edible product in another juxtaposed compartment. The package includes an elongated enclosure defined by a pair of transparent, flexible film strips bonded to one another around the periphery thereof by a liquid tight seal; and a membrane situated between the film strips, bonded to the periphery of the film strips by a liquid tight seal, partitioning the enclosure into a pair of juxtaposed, liquid tight compartments. An extrudable, edible product is separately contained in each of the compartments. Apparatus for continuously and successively forming, filling and sealing articulated arrays of such packaged products is also disclosed.

3 Claims, 3 Drawing Sheets

(56) References Cited

U.S. PATENT DOCUMENTS 3,539,794 A * 11/1970 Kennerly et al. ..... 362/34
3,575,027 A * 4/1971 Eisler ..... B21D 31/04 156/513
3,628,306 A * 12/1971 Jacobson ..... B65B 51/32 53/553
3,756,389 A * 9/1973 Firth ..... 206/219
3,846,569 A * 11/1974 Kaplan ..... 426/394
3,847,045 A * 11/1974 Willhite, Jr. ..... B26D 1/205 83/300
3,889,446 A * 6/1975 Simmons et al. ..... 53/451
3,940,905 A * 3/1976 Perry, III ..... 53/412
3,978,752 A * 9/1976 Meaden ..... B26F 1/20 83/332
3,978,753 A * 9/1976 Meaden ..... B26F 1/20 83/332
4,004,399 A * 1/1977 Borrello ..... B29C 65/18 53/554
4,085,569 A * 4/1978 Seragnoli ..... B65B 61/02 493/161
4,169,344 A * 10/1979 Ganz et al. ..... 53/546
4,215,524 A * 8/1980 Saylor ..... B65B 9/023 53/554
4,350,003 A * 9/1982 Greenawalt et al. ..... 53/548
4,532,753 A * 8/1985 Kovacs ..... 53/451
4,599,850 A * 7/1986 Kopp ..... B65B 65/02 156/583.1
4,630,429 A * 12/1986 Christine ..... B29C 65/18 156/515
4,631,905 A * 12/1986 Maloney ..... 53/554
4,635,316 A * 1/1987 Towne ..... B26D 5/08 138/118.1
4,699,035 A * 10/1987 Gall ..... B26D 1/0006 493/368
4,761,197 A * 8/1988 Christine et al. ..... 156/290
4,768,326 A * 9/1988 Kovacs ..... 53/374.8
4,934,227 A * 6/1990 Knorr ..... B26D 1/18 493/287
4,977,807 A * 12/1990 Kai ..... B26F 1/20 493/363
5,067,302 A * 11/1991 Boeckmann ..... 53/374.8
5,131,213 A * 7/1992 Shanklin et al. ..... 53/477
5,235,794 A * 8/1993 Center ..... B29C 66/83413 53/202
5,309,792 A * 5/1994 Gerhardt ..... B26D 1/0006 76/115
5,361,560 A * 11/1994 Sandolo ..... 53/111 RC
5,466,474 A * 11/1995 Gaylor ..... 426/394
5,470,418 A * 11/1995 Instance ..... 156/231
5,551,206 A * 9/1996 Fukuda ..... 53/75
5,678,392 A * 10/1997 Konno ..... 53/477
5,724,789 A * 3/1998 Corella ..... 53/450
5,813,197 A * 9/1998 Aguzzoli ..... 53/453
5,934,580 A * 8/1999 Maier et al. ..... 241/100
6,003,288 A * 12/1999 Sperry et al. ..... 53/552
6,006,501 A * 12/1999 Davis ..... B65B 9/2042 53/202
6,035,753 A * 3/2000 Coffey ..... B26F 1/18 83/332
6,135,869 A * 10/2000 Schutz ..... 452/32
6,245,367 B1 * 6/2001 Galomb ..... B65D 51/247 206/541
6,428,457 B1 * 8/2002 Fukuda et al. ..... 493/302
6,505,664 B1 * 1/2003 Blundell et al. ..... 156/515
6,543,202 B1 * 4/2003 Kelly ..... 53/228
6,662,530 B1 * 12/2003 Millon et al. ..... 53/450
6,725,634 B1 * 4/2004 Palmqvist et al. ..... 53/548
7,059,100 B2 * 6/2006 Babini et al. ..... 53/376.2
7,128,935 B2 * 10/2006 Germick ..... B65B 3/326 141/100
7,174,699 B1 * 2/2007 Wyman et al. ..... 53/547
7,254,929 B1 * 8/2007 Schutz et al. ..... 53/450
8,215,088 B2 * 7/2012 Vaillant et al. ..... 53/450
8,640,433 B2 * 2/2014 Tilley ..... 53/477
2002/0162305 A1 * 11/2002 Miyamoto et al. ..... 53/551
2004/0083684 A1 * 5/2004 Schroeder et al. ..... 53/410
2004/0231481 A1 * 11/2004 Floding ..... B26D 1/025 83/425
2005/0016124 A1 * 1/2005 Kinoshita et al. ..... 53/64
2006/0075724 A1 * 4/2006 Kammler ..... B29C 66/81431 53/451
2007/0084142 A1 * 4/2007 Matthews ..... 53/412
2008/0041023 A1 * 2/2008 Tsuruta ..... 53/548
2008/0172989 A1 * 7/2008 Deep ..... B65B 9/02 53/451
2009/0013654 A1 * 1/2009 Talacci ..... B29C 65/7891 53/548
2010/0159194 A1 * 6/2010 Boucher ..... B26D 5/12 428/138
2011/0000947 A1 * 1/2011 Cho ..... B26F 3/002 225/2
2011/0062041 A1 * 3/2011 Bum ..... 206/484
2012/0237643 A1 * 9/2012 Wegner et al. ..... 426/115

* cited by examiner

FLEXIBLE TUBULAR PACKAGE FOR EDIBLE PRODUCT

TECHNICAL FIELD OF THE INVENTION

This invention relates to packaged edible products and, more particularly, to flexible tubular compartmented packages for edible products and the method for continuously forming, filling and sealing articulated arrays of such products.

BACKGROUND OF THE INVENTION

Edible products, especially, flavored products such as confections and the like, that can be stored unrefrigerated in a liquid or semi-liquid form and then frozen by a consumer to a substantially solid, icy or slush-like consistency prior to eating are popular and desired. In particular, these types of edible products are desirably contained in squeezable, flexible, plastic film or the like package that can withstand freezing.

One popular type of freezable, edible, confection product, commonly called a freezer bar, is conventionally provided in an elongate tube-like package made of a flexible thermoplastic film material or the like. For consumption, the package is cut or torn open at the top by the consumer, and then squeezed from the bottom up to allow the frozen, cold confection to be extruded directly from the package into the consumer's mouth.

The present invention advantageously provides a squeezable, flexible tubular package for edible products provided with substantially co-extensive, liquid-tight compartments that hold a first edible product in one compartment separate from a second edible product held in another, juxtaposed compartment. The package, when opened dispenses an edible product from each compartment.

SUMMARY OF THE INVENTION

The present invention provides a squeezable, flexible package for an edible product that is easily opened with a knife or scissors or manually without the need for a sharp cutting implement. Additionally, the flexible package is compartmented so that two separate edible products can be dispensed together from the opened package directly into the mouth of the consumer or dish, as desired. The packaged edible product can be stored at room temperature, be subsequently frozen, and the package opened immediately before use. Alternatively, if the nature of the product so requires, it can be stored refrigerated and the package opened prior to use.

The squeezable, flexible tubular package includes an elongated compartmented enclosure defined by a pair of flexible film strips bonded to one another around the periphery thereof by a liquid tight seal and a sheet-form partitioning membrane between the film strips, bonded to the periphery of the film strips by a liquid tight seal. The flexible film strips can be transparent, opaque, metalized, foiled, and the like, as desired. The membrane partitions the enclosure into a pair of juxtaposed, liquid tight compartments, each of which contains an edible product. The membrane likewise can be opaque, metalized, foiled, and the like, as well as transparent, and can bear markings visible through transparent film strips that define the enclosure.

The sealed top margin of the tubular package defines a tab which can be grasped and torn or otherwise severed from the product to open and access the edible product. The tab includes a fully sealed upper region and an optional, unitary partially sealed lower region. Optionally, the tab can include a plurality of pockets in open communication with the interior of each compartment of the enclosure. The partially sealed lower region includes a plurality of spaced substantially parallel ribs which define the pockets therebetween.

An optional notch can be defined in the sealed side margin adjacent the tab and extends inwardly from an edge of the margin. In one embodiment, the notch is triangular shaped, and the apex of the notch extends through the sealed side margin and toward the space containing the edible product. The notch allows the tab to be easily torn from the product.

An array of squeezable, flexible, tubular packages for an edible product includes a plurality of elongated enclosures defined by a pair of transparent, flexible film sheets bonded to one another around the periphery thereof by liquid tight seals and by longitudinal, liquid tight bonding bands at spaced intervals within the periphery with a sheet-form membrane situated between the film sheets, bonded to the periphery of the film sheets and by said longitudinal bonding bands partitioning each enclosure into a pair of juxtaposed, liquid tight compartments. An edible product is packaged in each of the compartments. The edible product in each compartment can have a liquid, semi-solid, granular, powder, or paste consistency. Illustrative are flavored liquids, juices, gelatins, yogurts and similar edible products.

Each longitudinal bonding band can be slit, or is provided with a line of weakening, preferably defined by a string of perforations, for separating individual packages from the array.

In an articulated array of such packaged edible products, the products are joined but detachable along the longitudinal edges of their sealed side margins. Optionally, at least one of the sealed side margins for each product includes a notch therein. The packaged products can be detached from the array by cutting, as with scissors, or pulling apart at the line of weakening. In a preferred array embodiment, the line of weakening comprises a string of perforations defined by the longitudinal bonding bands.

The edible product in each compartment can have the same flavor, or a different yet complementary flavor from one another providing an organoleptically pleasing and desirable sensory mouth feel. The amount of edible product in each compartment can be the same or different. Likewise, the consistency of the product in each compartment can be the same or different, as desired. Desirable and visually pleasing effects also can be provided by including in the edible product in at least one of the compartments coloring certified for use in foods and candy confections. The coloring in the edible product in each compartment can be same, but preferably is different to provide a visibly contrasting appearance between the edible products in each compartment. Depending on the flavor desired in the finished edible product, sufficient food coloring can be employed as needed to impart a color typically associated with the selected flavor, such as red for cherry, or to create a visually fanciful vivid color. Particularly preferred is a red colored product in a first compartment and a blue colored edible product in the juxtaposed second compartment; however, any desired combination of colors can be used. If desired, the edible food product can be fortified with nutritional supplements, medication, vitamins, and the like.

Advantageously, the squeezable, flexible tubular packages of this invention can be used for delivering paired edible food products, food supplements, confections, medicaments, and the like in either liquid or substantially solid form. In particular, the packages can be frozen in a home refrigerator by a consumer.

Other features and advantages of the present invention will become readily apparent from the following detailed description, the appended drawings, and the accompanying claims.

BRIEF DESCRIPTION OF THE DRAWINGS

The attached drawings show a presently preferred embodiment of the present invention, wherein like numerals in various views refer to like elements.

DESCRIPTION OF THE PREFERRED EMBODIMENTS

Figure 1:
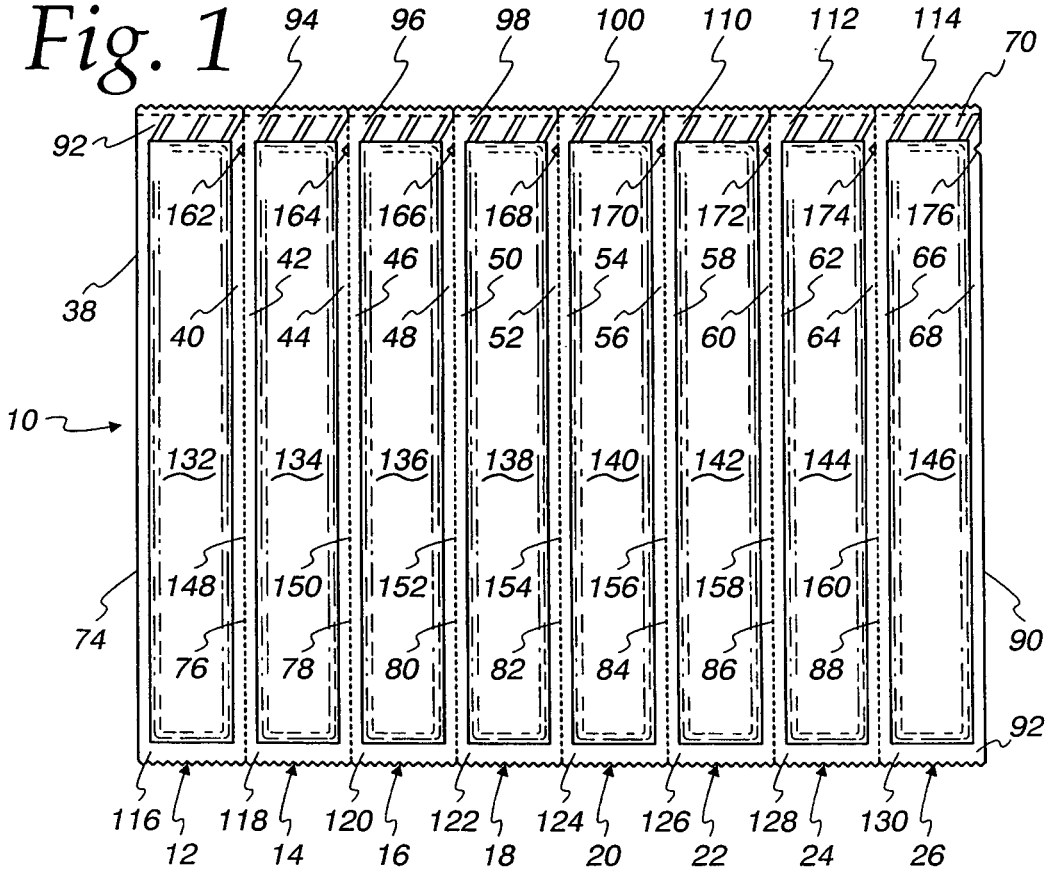
FIG. 1 is a front elevational view of an articulated array of squeezable, flexible tube-like packages for edible products embodying the principles of the present invention.

The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

For ease of the description, the packaged edible product is illustrated in the form of a freezable confection, but is not limited thereto. The packaged product embodying the present invention is described herein below in its usual vertical dispensing orientation as shown in the accompanying drawings. The apparatus for making articulated arrays of these packaged confection products is likewise described in its usual vertical operating position. As such, terms such as upper, lower, vertical, etc., will be used herein with reference to these usual positions.

Referring now to the drawings, and more particularly to FIG. 1, there is shown therein an articulated array 10 of tubular packages for confection products or packages 12, 14, 16, 18, 20, 22, 24 and 26 constructed in accordance with the present invention. Although FIG. 1 depicts an array 10 including eight articulated products or packages, it is understood that the array 10 preferably includes up to ten articulated confection products.

Figure 3:
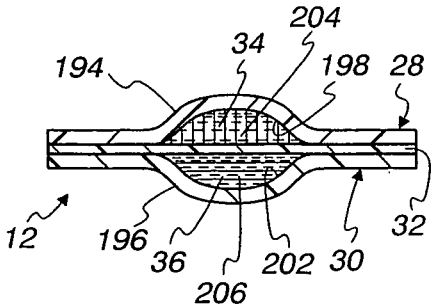
FIG. 3 is a horizontal cross-sectional view of a compartmented packaged edible product taken along the plane 3-3 of FIG. 2.

The array 10, and thus each of its articulated packages, is composed of an elongated enclosure defined by a pair of opposed transparent, flexible film sheets or strips 28 and 30, with a membrane 32 situated therebetween as seen in FIG. 3. The flexible films are heat sealable, multi-layer barrier films used in food packaging, and are utilized to define the exterior of the elongated enclosures as well as the partition therebetween.

Partitioning membrane 32 is sealed between the films 28 and 30 by a liquid tight seal, separating each elongated enclosure into a pair of juxtaposed, liquid tight compartments.

A variety of commercially available heat sealable barrier films can be utilized in practicing the present invention. The film thickness can vary from about 1.5 mils to about 3 mils. The outer film sheets usually are thicker than the membrane sheet, having a thickness of about 2 mils to about 3 mils. The membrane sheet, on the other hand, usually has a thickness of about 1.5 mils to about 2 mils. A preferred film for the outer film sheets is a heat sealable, food grade polyethylene therephthalate (PET) low density polyethylene (LDPE) polyethylene (PE) laminate having a thickness of about 2.7 mils and commercially available under the designation M-9605 from Curwood, Inc, Neenah, Wis. 54956, U.S.A.

Barrier films suitable for use as the membrane preferably have an oxygen transmission rate (OTR) of no more than about 3 cubic centimeters per 100 square inches per 24 hours at 73° F. and 0% relative humidity (RH) and a moisture vapor transmission rate (MVTR) of no more than about 3 grams of water per 100 square inches per 24 hours at 100° F. and 90% relative humidity (RH). Particularly preferred are co-extruded, heat sealable films about 1.5 to 2 mils thick, having an ethylene-vinyl alcohol copolymer (EVOH) barrier layer and linear low density polethylene (LLDPE) sealant layers.

Illustrative of such barrier films are the packaging film commercially available under the designation LIQUIFLEX® WIO-002951 and LIQUIFLEX® 4620-F from Curwood Inc., Neenah Wis. 54956, U.S.A. These particular barrier films exhibit an OTR of less than 0.5 cc/100 in.$^2$/24 hrs. at 73° F. 0% RH and a MVTR of less than 0.5 grams of $H_2O$/100 in.$^2$/24 hrs. at 100° F. 90% RH. The barrier films have a thermal conductivity that allows for the quick and efficient freezing of the edible products in the compartments providing good storage life. References to the tubular package or product includes the partitioning membrane 32 as well as opposed heat sealable film strips 28 and 30.

FIG. 3 illustrates a topical colored liquid edible product embodiment in which the edible product 34 in one compartment has a red color and the edible product 36 in the juxtaposed compartment has a blue color.

As shown in FIG. 1, the array 10 includes a plurality of spaced-apart and parallel longitudinally sealed side strips or bonding bands 38, 40, 42, 44, 46, 48, 50, 52, 54, 56, 58, 60, 62, 64, 66 and 68 and transverse top and bottom sealed strips 70 and 72, respectively, which define the individual packages 12, 14, 16, 18, 20, 22, 24, and 26. The sealed strips of the array 10 comprise portions of the membrane 32 and opposed sheets 28 and 30 of thermoplastic material which have been either fully or partially heat and pressure sealed together as later described. More particularly, bonding band 38 defines a longitudinally, fully sealed side margin and outer edge 74 of the package 12. The contiguous bonding bands 40 and 42 define articulated longitudinal fully sealed bonding bands as side margins and abutting edges 76 of the packages 12 and 14, respectively. Strips 44 and 46 define the articulated longitudinal fully sealed side margins and abutting edges 78 of the packages 14 and 16, respectively. Strips 48 and 50 define articulated longitudinal fully sealed bonding banks as side margins and abutting edges 80 of the packages 16 and 18, respectfully. Strips 52 and 54 define the articulated longitudinal fully sealed bonding band side margins and abutting edges 82 of the packages 18 and 20, respectively. Strips 56 and 58 define longitudinal fully sealed bonding bands as side margins and abutting edges 84 of the packages 20 and 22, respectively. Strips 60 and 62 define the longitudinal fully sealed bonding bands as side margins and abutting edges 86 of the packages 22 and 24, respectively. Strips 64 and 68 define longitudinal fully sealed bonding bands as side margins and abutting edges 88 of the packages 24 and 26. Bonding band 68 defines a longitudinal fully sealed side margin and outer edge 90 of the package 26.

The transverse top sealed strip 70 of the array 10 defines the transverse top sealed margins 92, 94, 96, 98, 100, 110, 112 and 114 of the products 12, 14, 16, 18, 20, 22, 24 and 26, respectively. The transverse bottom sealed strip 72 of the array 10 defines the transverse bottom sealed margins 116, 118, 120, 122 124, 126, 128 and 130 of the packages 12, 14, 16, 18, 20, 22, 24, and 26, respectively.

The sealed side, top and bottom margins of each of the packages 12, 14, 16, 18, 20, 22, 24 and 26 together define longitudinal enclosures or pouch-like spaces 132, 134, 136, 138, 140, 142, 144 and 146 respectively which contain the freezable confection. A preferred exterior dimension for a longitudinal enclosure for a confection is about 10 to about 10.5 inches, more preferably about 10.25 inches in length and about 1 to about 1.75 inches, more preferably about 1.5 inches in width. A preferred compartmented package for a confection such as a freezer bar, is dimensioned to hold a total volume of about two ounces of product, with half the amount contained in each compartment. The foregoing dimensions described are not intended to limit the configuration of the packages thereto.

A plurality of spaced-apart and parallel severance lines 148, 150, 152, 154, 156, 158, and 160 define the abutting edges 76, 78, 80, 82, 84, 86 and 88 extend centrally and longitudinally through the sealed longitudinal bonding bands 40, 42; 44, 46; 48, 50; 52, 54; 56, 58; 60, 62; and 64, 66; respectively. In the embodiment of FIG. 1, the severance lines comprise lines of weakening or severance illustrated, for example, as a string of perforations which allow a consumer to separate adjoining articulated products from each other. The severance lines can also comprise lines along which the products are cut apart by knives, or the like, after the array 10 has been formed but prior to packaging.

The array 10 further includes a plurality of optional, spaced-apart and aligned notches 162, 164, 166, 168, 170, 172, 174 and 176 defined in the sealed side margins 40, 44, 48, 52, 56, 60, 64 and 68, respectively of the products 12, 14, 16, 18, 20, 22, 24 and 26 respectively. The notches 162, 164, 166, 168, 170, 172, 174 and 176 are positioned adjacent to and immediately below the sealed top margins 92, 94, 96, 98, 100, 110, 112 and 114, respectively of the products 12, 14, 16, 18, 20, 22, 24 and 26, respectively.

Figure 2:
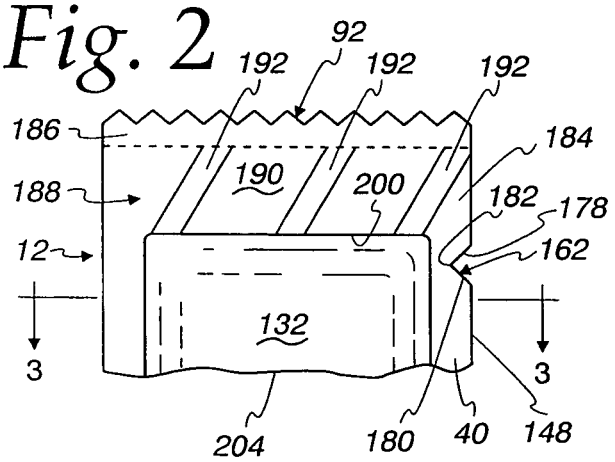
FIG. 2 is a broken enlarged front elevational view of the sealed top margin of one of the packages of the array of FIG. 1.

FIG. 2 depicts the tubular packaged product 12 after it has been separated from the array 10. As shown therein, the notch 162 in product 12 extends through the sealed side margin 40 of the product 12 and includes first and second spaced-apart sides 178 and 180 which converge inwardly away from the line of severance 148 toward the enclosure 132 and terminate in an apex or point 182 which extends toward the pouch 132 and is spaced therefrom. The notch 162 and margin 40 together define a grip tab 184. Notches 164, 166, 168, 170, 172, 174 and 176 on products 14, 16, 18, 20, 22, 24 and 26 are similarly structured. The notch embodiment is not limited to the triangular shape illustrated and can be a generally horizontal straight slit, or the like, so long as a grip tab is defined that facilitates manual opening of the package.

The top margins 92, 94, 96, 98, 100, 110, 112 and 114 of the products 12, 14, 16, 18, 20, 22, 24 and 26, respectively, are partially heat and pressure sealed as shown in FIG. 2 which depicts the sealed top margin 92 of the product 12. In particular, the sealed top margin 92 of the margin 38 includes a fully sealed upper region 186 and an optional, unitary partially sealed lower ribbed region 188. The region 186 is defined by a strip of the top margin 92 where the membrane 32 and opposed sheets 28 and 30 of thermoplastic film material are fully and completely heat and pressure sealed in liquid tight relationship to each other. The optional lower ribbed region 188 is defined by a lower strip of the top margin 92 where the opposed sheets 28 and 30 are only partially sealed to the membrane 32 and each other. In particular, the ribbed region 188 includes a plurality of optional open pockets 190 defined by a plurality of sealed ribs 192 which extend along the width of the sealed top margin 92 in a spaced-apart, alternating and acute angle relationship relative to the longitudinal axis of the pouch 132. The ribs 192 are defined by strips of the membrane 32 and sheets 28 and 30 which are completely sealed to each other.

Each of the pockets 190 includes spaced-apart walls 194 and 196 which are defined by the unsealed strips of the membrane 32 and opposed sheets 28 and 30. As shown in FIG. 3, the walls 194 and membrane 32 define an interior cavity 198 of a first compartment 204.

Compartment 204 is illustrated as containing a first, red-colored confection product 34. The wall 196 and membrane 32 define an interior cavity 202 of a second, juxtaposed compartment 206. Compartment 206 is illustrated as containing a second, blue-colored confection product 36.

Each of the pockets 190 have an opening 200 adjacent to, and in communication with, the interior cavity 198 of the first compartment 204 of the enclosure or package 132 containing the confection, as seen in FIG. 2, and similarly adjacent to, and in communication with, the interior cavity 202 of the second, juxtaposed compartment 206 of the enclosure or package 132. Preferably, the pockets 190, if present, occupy about eighty (80) percent of the surface area of the ribbed region 188.

A consumer can separate the packages 12, 14, 16, 18, 20, 22, 24 and 26 in the array 10 from each other along their respective perforation or severance lines. The package 12 shown in FIG. 2 and, of course each of the other packages in the array 10, is then opened manually by grasping the tab 184 and then tearing the top sealed margin 92 away from the top of the packages 12 in a horizontal direction.

The thermoplastic film material is preferably uniaxially structured to tear only in a horizontal direction away from the notch 162. The notch 162 allows the sealed margin 92 to be easily and quickly manually torn and further allows the compartmental enclosure 132 to be easily and quickly accessed. In particular, the notch 162 dispenses with the need to use a knife or scissors to cut through the sealed side margin 40 and the enclosure 132. The ribbed lower region 188 of the top margin 92 allows the margin 92 to be firmly and tightly gripped while the product 12 is opened.

The pockets 190 provide the advantage of eliminating the presence of any frozen confection in the opened areas of enclosure 132 located in each compartment between the bottom of the sealed top margin 92 and the notch 162 when the sealed top margin 92 is torn off the product 12. According to the invention, grasping of the ribbed region 188 of the margin 92 causes flattening of the pockets 190 which, in turn, causes air in the pockets 190 to flow downwardly through the opening 200 and into each compartment of the enclosure 132 which causes an increase in the air pressure in the opened areas of the enclosure 132. This, in turn, pushes the frozen confection products, 34, 36, present in each compartment downwardly into its respective compartment in the enclosure 132 and out of the opened areas. As a result, spilling of the confection is minimized when the package 12 is manually torn open along the notch 162.

The flexible, tubular, compartmented product packages embodying the present invention can be produced by positioning a membrane sheet between a pair of outer film sheets and forming paired longitudinal tubes of predetermined length by bonding together the three sheets using heat sealing techniques. The tubes so produced are heat sealed to form a bottom portion then filled with a desired product and thereafter heat sealed to form a top seal. Arrays of product filled, sealed, compartmented tubes can be packaged together, or individual, product filled, compartmented tubes can be first severed from one another and then further wrapped or boxed as desired.

A packaging apparatus suitable for making such flexible, tubular compartmented packages has a substantially vertical frame which supports a pair of parallel, heat sealing rolls which are rotatably mounted to the frame, driven, and spaced from one another to receive therebetween and pinch together a membrane sheet flanked by outer film sheets. Each of the rolls defines at least one opposed circumferential groove or channel, and the rolls together define at least one open passageway between the respective opposed grooves. The pinching action by the heat sealing rolls is sufficient to effect liquid tight heat seal, and to produce compartmented tubes which are transversely sealed so as to receive and retain a food product introduced therein. Rotation of the heat sealing rolls transports the resulting longitudinally bonded outer sheets and the membrane sheet a predetermined distance to a transverse heat sealing station where the compartmented tubes are transversely sealed to form a bottom portion for each tube as stated hereinabove.

A membrane sheet supply as well as a pair of flanking outer film sheet supplies, usually in the form of rollstock, are mounted to the frame above the heat sealing rolls and positioned so that the membrane sheet is located between the two substantially co-extensive outer film sheets, and all three sheets can be fed concurrently into a rip or gap between the driven, channeled or grooved heat sealing rolls. The sheets are pinched together by the rolls and longitudinally bonded by heat sealing to produce elongated, compartmented tubes that are transported downwardly, in the machine direction by the driven heat sealing rolls.

Product dispensing nozzles are situated on each side of the membrane sheet between the membrane sheet and its flanking outer film sheet so that the dispensing apertures of the nozzles are positioned to dispense a product aligned into the adjacent compartment of the formed compartmented tube. The number of dispensing nozzles is dependent in each case on the number of compartment tubes that have been formed as the sheets pass through the heat sealing rolls and on the nature of the product to be dispensed, but at least one dispensing nozzle is situated on each side of the membrane sheet.

As the filled compartmented tubes move downwardly, a transverse top seal is formed for each filled tube at the transverse heat sealing station concurrently with forming a transverse bottom seal for the next array of compartmented tubes. A knife assembly downstream from the transverse heat sealing station separates consecutive arrays of product filled compartmented tubes.

Figure 4:
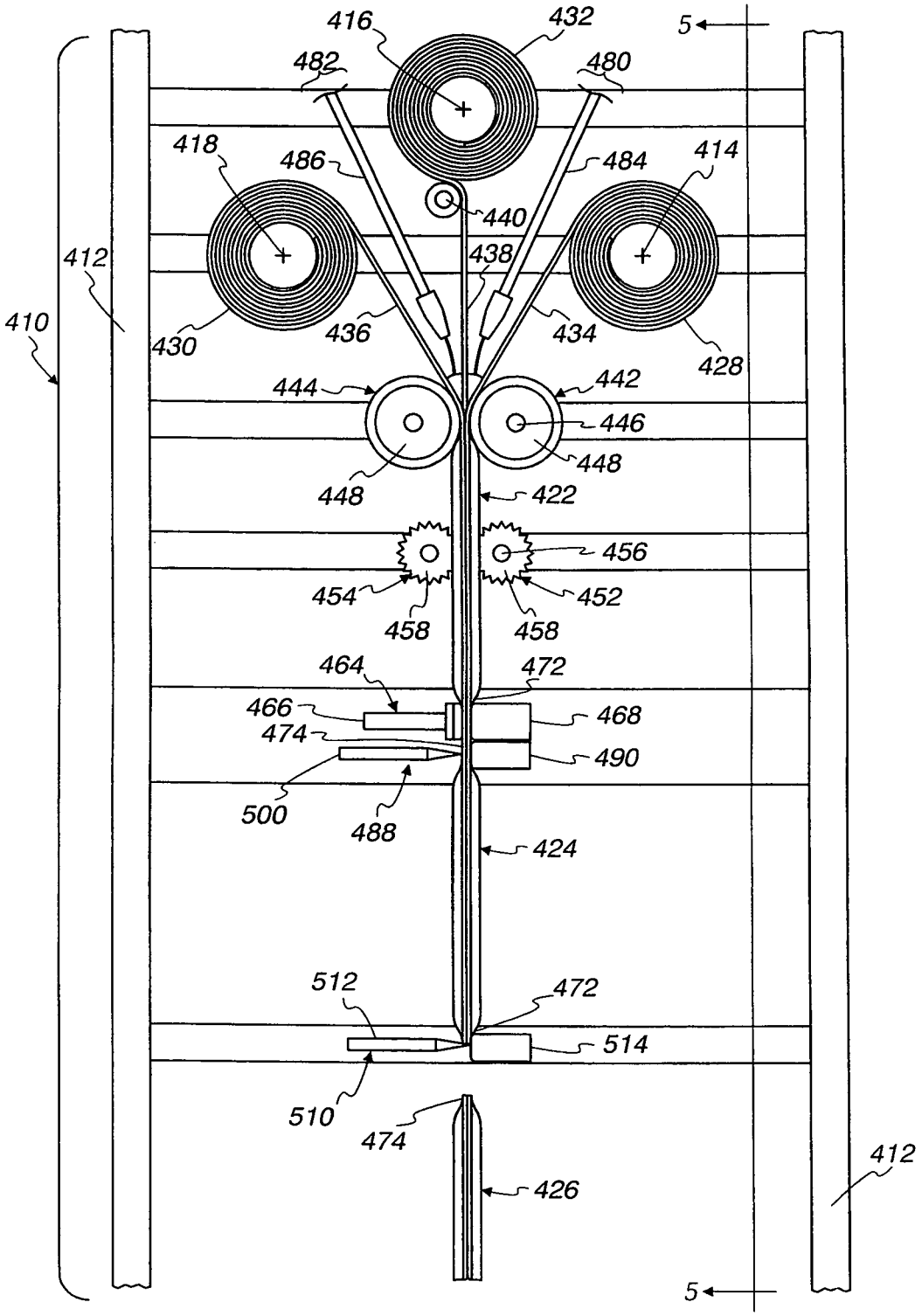
FIG. 4 is a simplified side elevational view of an apparatus for continuously forming, filling and sealing articulated arrays of the edible products of the present invention.
Figure 5:
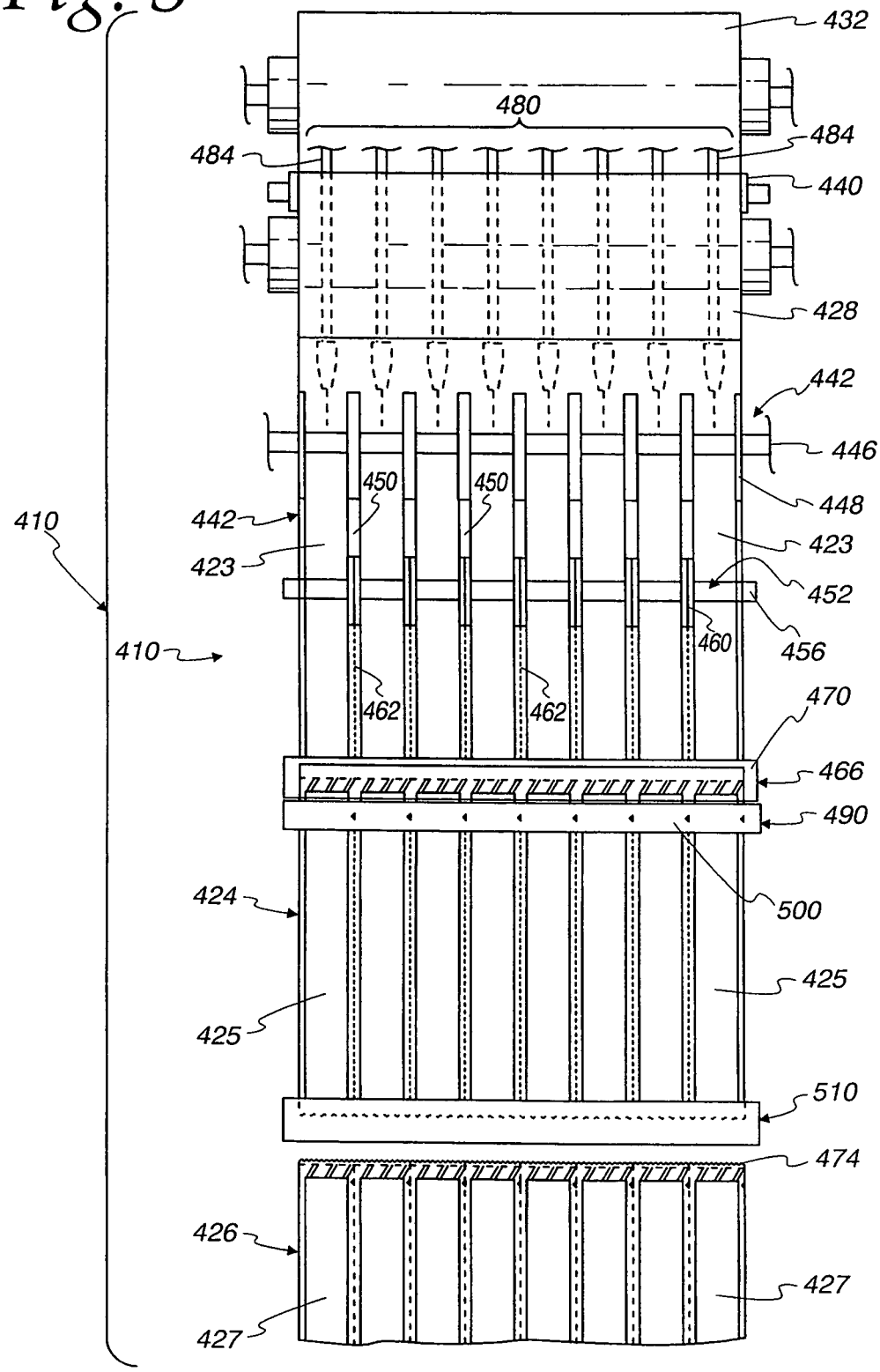
FIG. 5 is a simplified front elevational view of the apparatus of FIG. 4 taken along the plane 5-5 of FIG. 4.

FIGS. 4 and 5 depict an apparatus embodiment 410 for continuously and successively forming, filling and sealing a plurality of articulated arrays 422, 424 and 426 each including a plurality of articulated tube-like packages or products 423, 425 and 427.

The apparatus 410 includes spaced-apart and parallel film supply rolls 428 and 430, carried on spindles 414 and 418, respectively, and mounted to frame 412, from which sheets or webs 434 and 436 of heat-sealable thermoplastic film material are unwound. Membrane supply roll 432 mounted to frame 412 carried by spindle 416 provides a partitioning sheet or membrane 438 which is positioned between sheets 428 and 430 by an idler 440. Sheets 434 and 436 with the sheet-form partitioning membrane 438 therebetween are brought together into face-to-face relationship and then fed downwardly through the apparatus 410 to form and fill the compartmented tubular packages.

The apparatus 410 further includes a pair of spaced-apart and parallel sealing wheel assemblies 442 and 444 also mounted to frame 412 and positioned on opposite sides of the downwardly advancing sheets 434, 438 and 436. Each of the sealing wheel assemblies 442 and 444 extends across the width of the apparatus 410 and the width of the sheets 434, 438 and 436. Each of the wheel assemblies 442 and 444 includes an elongate and transverse shaft 446 and a plurality of wheels 448 mounted to, and extending along the length of the shaft 446 in spaced-apart and parallel relationship.

The wheels 448 of the opposed sealing wheel assemblies 442 and 444 are heated and are vertically co-planarly aligned with each other and contact the opposed sheets 434 and 436, respectively, as the sheets 434, 438 and 436 pass between the sealing wheel assemblies 442 and 444. The temperature of heated wheels 448 is controlled by a thermostat. The spacing between the wheels 448 and the sheets 434 and 436 causes the sheets 434 and 436 to be pressed toward one another and to pinch membrane 438 therebetween into abutting relationship to form a plurality of longitudinally, spaced-apart and parallel liquid tight, heat sealed side strips 450 in each of the arrays 422, 424 and 426. The sealed side strips 450 are cut as explained hereinafter to form side margins which correspond to the sealed longitudinal side strips 38, 40, 42, 44, 46, 48, 50, 52, 54, 56, 58, 60, 62, 64, 66 and 68 shown in FIG. 1.

Perforation wheel assemblies 452 and 454 are positioned on frame 412 below and downstream of the sealing wheel assemblies 442 and 444. Each of the perforation assemblies 452 and 454 is positioned on opposite sides of the array and includes an elongate shaft 456 which extends transversely across the width of the apparatus 410 in a generally spaced-apart and parallel relationship to the downwardly advancing tube or product arrays 422, 424 and 426. A plurality of perforation wheel assemblies 458 are mounted to, and extend along the length of, the shaft 456 in spaced-apart and parallel relationship.

Each of the perforation wheel assemblies includes a peripheral circular knife or blade with a plurality of spaced-apart and circumferentially extending teeth. The perforation wheel assemblies 452 and 454 are positioned relative to each other and the tube arrays such that the wheels 458 thereof are opposite to and aligned with each other and the longitudinal sealed strips 450 formed in each of the tube arrays 422, 424 and 426. Alternatively, slitting knives can be provided in lieu of the perforation assemblies, if desired.

Each of the wheels 458 contacts the tube arrays as the arrays advance downwardly through the apparatus 410 and cuts a longitudinally extending and centrally located line of perforations or severance lines 462 in each of the longitudinally extending sealed strips 450 of the tube arrays. The severance lines 462 correspond to the severance lines 148, 150, 152, 154, 156, 158 and 160 shown in the array 10 of FIG. 1. FIGS. 4 and 5 show perforations 452 being formed in the strips 450 of the tube array 422.

A cross or transverse seal device 464 is positioned below and downstream of the cutting wheel assemblies 452 and 454. The cross seal device 464 includes a laterally reciprocable heat sealing head assembly 466 positioned on one side of the downwardly advancing tube arrays and a stationary heat seal anvil 468 positioned on the opposite side of the tube arrays directly opposite and in horizontal co-planar alignment with the head assembly 466. As shown in FIG. 5, the head assembly 466 includes an elongate cross seal head 470 which extends transversely across the width of the apparatus 410 and, more particularly, across the width of the downwardly advancing tube arrays. The head 470 is laterally reciprocable between a retracted position and an extended position in which the head 470 contacts the downwardly advancing tube arrays at a predetermined point for forming and sealing the transverse bottom longitudinal sealed margin of one array and the articulated transverse top sealed margin of a second articulated array downstream from the first articulated array.

FIGS. 4 and 5 depict the simultaneous formation and sealing of the transverse sealed bottom margin 472 of the tube array 422 and the articulated transverse sealed top margin 474 of the articulated tube array 424 downstream therefrom.

A first confection fill assembly 476 includes a first liquid confection dispenser 480 positioned between the film supply roll 428 and membrane supply roll 432 and an opposing second confection fill assembly 478 including a second liquid confection dispenser 482 positioned between the membrane supply roll 432 and the film supply roll 430. A pair of nozzle banks 480 and 482 have a plurality of spaced-apart nozzles 484 and 486 that extend downwardly between the respective sheets into the respective compartment of the enclosures into which the liquid confection is to be packaged. The liquid confection is gravity fed to the nozzles during the fill process. Liquid confection is supplied to each nozzle from an external source, such as a tank or similar reseal.

As illustrated in FIG. 5, spaced-apart nozzles 484 of nozzle bank 482 extend downwardly into the space between sheet 434 and 438 into the apparatus 410 and into the enclosures or pouches of the products of each of the arrays. The liquid confection is dispensed from each of the nozzles 484 into the first compartment of each of the pouches immediately following the formation and sealing of the transverse bottom sealed strip 472 of each of the product arrays. FIGS. 4 and 5 depict the nozzles 484 extending into the first compartment of the pouches of the products 423 of the array 422. Dispensing rates from each nozzle can be made individually adjustable.

An optional, laterally reciprocable knife carriage assembly 488 is positioned below and downstream of the cross seal assembly 464. As shown in FIGS. 4 and 5 the knife carriage 488 is positioned generally transversely to the downwardly advancing product arrays and is laterally reciprocable relative thereto. The knife carriage 488 is positioned on one side of the arrays and a stationary anvil 490 is positioned on the opposite side of the arrays directly opposite and in horizontal co-planar relationship with the knife carriage 488. The knife carriage 488 is adapted to cut notches in the arrays, such as the notches 162, 164, 166, 168, 170, 172, 174 and 176 in the tube array 10 of FIG. 1. FIG. 4 depicts the knife carriage assembly 488 in its retracted position immediately prior to the advancement of the arrays 422 and 424 to where the sealed top strip 474 of the array 424 is positioned directly opposite the knife carriage assembly 488 for forming the notches shown in FIG. 1. The apparatus 410 additionally includes a cross or transverse knife assembly 510 which, as shown in FIGS. 4 and 5, includes a laterally reciprocable elongate knife 512 which extends across the width of the apparatus 410 and the width of the downwardly advancing arrays. A stationary anvil 514 is positioned on the other side of the arrays in horizontally co-planar relationship with the knife 512. The knife 512 is laterally reciprocable between a retracted position and an extended position in which the knife 512 cuts and separates the arrays from each other after the arrays have been formed, filled and completely sealed as described above. The knife 512 cuts the articulated arrays between their respective articulated sealed top and bottom margins as shown in FIGS. 4 and 5. FIGS. 4 and 5 depict the array 426 being separated from the array 424 between their respective top and bottom sealed margins 472 and 474 respectively.

It is understood, of course, that in the method for forming, filling and sealing the arrays 422, 424 and 426 described above, the sheets 434, 438 and 436 are continuously fed into and through the apparatus 410 and the various seal and knife assemblies described above perform their operations in either a simultaneous or sequentially timed relationship.

In the apparatus embodiment of FIGS. 4 and 5, the head 470 is extended laterally into the sheets 434, 438 and 436 to form and seal the top margin 474 of the array 424 and the bottom margin 472 of the array 422 at intermittent intervals which are timed according to the speed at which the sheets 434, 438 and 436 are advanced through the apparatus 410 and the desired length of each of the packages. The knife 512 separates the arrays 424 and 426 from one another. The packages 423 of the array 422 are filled with liquid confection immediately following the formation and sealing of the bottom margin 472 of the array 422 as shown in FIGS. 4 and 5. The optional knife carriage assembly 488 cuts the notches in the tube arrays at intermittent intervals following the cross-sealing step and the advancement of the tube arrays. It is also understood that the perforation wheel assemblies 452 and 454 are optional and can be substituted with a similarly structured knife assembly positioned between the knife carriage assemblies 488 and 510 for separating the individual products of each of the arrays from each other prior to packing the products in cartons for shipping or storage At ambient room temperature, edible products, such as confections, typically are liquid, flowable compositions containing, among other ingredients, flavorings and coloring as desired for achieving the desired organoleptic sensory mouth feel and visual appeal at ambient room temperature and when refrigerated or frozen.

The film materials for the tubular packages preferably are transparent so that the appearance of the edible product present in each of the compartments of the package is readily visible to the consumer. The membrane also can be transparent, translucent, or opaque depending on the visual effect desired. Additionally, the membrane material can have markings thereon, such designs, patterns, lettering, instructional indicia, and the like that is visible to the consumer through the outer, transparent film material of the tubular package.

For example, when the product is a substantially clear liquid at ambient room temperature, a clear membrane would provide the consumer an uninterrupted view of the contents of both of the compartments from either side. Where a confection, or edible product, comprises a transparent composition in one compartment and a creamy, substantially opaque composition in the juxtaposed compartment, the membrane preferably is an opaque material.

For visibly distinguishing the edible product in one compartment from the edible product in the other juxtaposed compartment, coloring certified for use in foods, confections and oral medications is added to the composition present in at least one compartment. For convenience, such certified colorings are commonly referred to as food coloring. For maximizing the distinction, coloring is added to the composition. The coloring can be the same or similar in hue or tone in each composition, or different to provide a contrasting but pleasing visual effect when the package is viewed from each side.

Depending on the flavor desired in the finished edible product, sufficient coloring can be employed as needed to obtain a color typically associated with the selected flavor, such as red for cherry, blue for blueberry, yellow for lemon, orange for orange, and the like. Particularly preferred is a red color in the edible product in one compartment and a blue color in the edible product of the juxtaposed compartment of the tubular package of each array as seen in FIG. 3.

The selection of the flavor and/or coloring is unlimited, as long as the selected flavor and/or coloring ingredients are compatible and stable in contact with the film materials and membrane material of the packaging, during storage at room temperature, when refrigerated, or when frozen in the freezer section of a home or store refrigerator.

The compartmented flexible tubular packages of this invention advantageously provide simultaneous delivery of two similar, or dissimilar edible products. For example, in one embodiment, the edible product in one compartment can have a selected flavor and the edible product in the other, juxtaposed compartment can have a complementary flavor to provide a novel sensory mouth feel. In another embodiment, the edible product in one compartment can be unflavored and the edible product in the juxtaposed compartment can be flavored.

Thus, the compartmented tubular packages of this invention also can be used for such edible products as food supplements, for oral ingestible medicaments, and the like.

From the foregoing, it will be observed that numerous modifications and variations can be effected without departing from the true spirit and scope of the novel concepts of the present invention. It will be appreciated that the present disclosure is intended as an exemplification of the invention, and is not intended to limit the invention to the specific embodiments illustrated. It is intended to cover by the appended claims all such modifications as fall within the scope of the claims.

We claim:

1. A packaging apparatus for an articulated array of a-flexible, tubular, compartmented packages which comprises:

a substantially vertical frame;

a pair of driven, parallel, grooved heat sealing rolls rotatably mounted to the frame, each heat sealing roll defining at least one opposed circumferential groove and the rolls together defining open passageways between respective opposed grooves;

a membrane sheet supply mounted to the frame above the heat sealing rolls and positioned to feed continuously a membrane sheet between the heat sealing rolls;

an outer film sheet supply mounted to the frame on each side of the membrane sheet supply and positioned to feed continuously a substantially co-extensive outer film sheet between the heat sealing rolls on each side of the membrane sheet and in a face-to-face relationship with the membrane sheet;

downwardly extending stationary liquid product dispensing nozzles on each side of the membrane sheet between the membrane sheet and adjacent outer film sheet; and a transverse heat sealing device having a laterally reciprocatable heat sealing head assembly and a stationary heat seal anvil mounted to the frame a predetermined distance below the heat sealing rolls and adapted to fuse together a portions of the membrane sheet and the outer film sheets contiguous therewith while simultaneously forming and sealing an articulated transverse bottom sealed margin of one articulated array and an articulated top sealed transverse margin of another contiguous articulated array downstream from said one articulated array, the articulated top sealed margin comprising a fully sealed top region and a unitary, partially sealed ribbed region which includes a plurality of open pockets in communication with an interior cavity of a compartment in the compartmented packages and defined by a plurality of sealed ribs which extend at an acute angle along the width of the top sealed margin; and a transverse knife assembly below the transverse heat sealing device which knife assembly includes a laterally reciprocable knife and an opposed stationary anvil;

said parallel, grooved sealing rolls being spaced from one another at a distance sufficient to pinch therebetween and heat-seal to one another the membrane sheet and the outer film sheet at pinch sites to form compartmented packages having two adjacent longitudinal compartments; and said stationary liquid dispensing nozzles being positioned to dispense a liquid product into the adjacent longitudinal compartments formed by the sealing rolls.

2. The packaging apparatus in accordance with claim 1 wherein each heat-sealing roll defines a plurality of opposed circumferential grooves.

3. The packaging apparatus in accordance with claim 1 further including perforation wheel assemblies between the heat sealing rolls and the transverse heat sealing device and spaced for contact with longitudinal seams defining the tubular compartmented package.

* * * * *